US012339037B2

(12) United States Patent
Quinn

(10) Patent No.: US 12,339,037 B2
(45) Date of Patent: Jun. 24, 2025

(54) INDIRECT WATER HEATER

(71) Applicant: Bryan D. Quinn, Morrison, CO (US)

(72) Inventor: Bryan D. Quinn, Morrison, CO (US)

( * ) Notice: Subject to any disclaimer, the term of this patent is extended or adjusted under 35 U.S.C. 154(b) by 671 days.

(21) Appl. No.: 17/649,292

(22) Filed: Jan. 28, 2022

(65) Prior Publication Data

US 2022/0243955 A1 Aug. 4, 2022

Related U.S. Application Data

(60) Provisional application No. 63/199,893, filed on Feb. 1, 2021.

(51) Int. Cl.

| | |
|---|---|
| ***F24H 4/02*** | (2022.01) |
| ***F24H 9/18*** | (2022.01) |
| ***F24H 9/20*** | (2022.01) |
| ***F28D 7/02*** | (2006.01) |
| ***F28F 9/22*** | (2006.01) |
| ***F28F 9/26*** | (2006.01) |

(52) U.S. Cl.

CPC ..... *F24H 4/02* (2013.01); *F24H 9/18* (2013.01); *F24H 9/2007* (2013.01); *F28D 7/02* (2013.01); *F28F 9/22* (2013.01); *F28F 9/26* (2013.01)

(58) Field of Classification Search

USPC ..... 237/19

See application file for complete search history.

(56) References Cited

U.S. PATENT DOCUMENTS

| | | | | |
|---|---|---|---|---|
| 3,435,627 | A * | 4/1969 | Castillo | F28D 7/022 62/394 |
| 3,976,129 | A * | 8/1976 | Silver | F28D 7/14 431/157 |
| 4,321,943 | A | 3/1982 | Haws | |
| 4,671,351 | A | 6/1987 | Rappe | |
| 4,750,472 | A | 6/1988 | Fazekas | |
| 4,832,259 | A | 5/1989 | Vandermeyden | |
| 4,936,289 | A | 6/1990 | Peterson | |
| 5,228,413 | A * | 7/1993 | Tam | F24H 1/48 122/15.1 |
| 7,475,703 | B2 | 1/2009 | Kempf et al. | |
| 2010/0034528 | A1 * | 2/2010 | Willis | F24H 9/0021 392/451 |

FOREIGN PATENT DOCUMENTS

| | | | | |
|---|---|---|---|---|
| GB | 2098312 A * | 11/1982 | | F24H 1/208 |
| WO | WO-0045093 A1 * | 8/2000 | | F24D 3/087 |

* cited by examiner

*Primary Examiner* — Steven B McAllister
*Assistant Examiner* — John E Bargero
(74) *Attorney, Agent, or Firm* — Trenner Law Firm, LLC; Mark Trenner

(57) ABSTRACT

An example indirect water heater is disclosed having a water storage tank with a primary heat exchanger. A heating fluid inlet of the primary heat exchanger receives a heating fluid from an external heat source into the primary heat exchanger. A heating fluid outlet of the primary heat exchanger returns the heating fluid to the external heat source after traveling through the primary heat exchanger. A secondary heat exchanger has a water source inlet and a water source outlet. The secondary heat exchanger is provided in thermal connection with the primary heater exchanger to preheat a source water before discharging the source water from the water source outlet into the water storage tank.

9 Claims, 5 Drawing Sheets

INDIRECT WATER HEATER

PRIORITY CLAIM

This application claims the priority filing benefit of U.S. Provisional Patent Application No. 63/199,893 filed Feb. 1, 2021 for "Indirect Water Heater" of Bryan D. Quinn, hereby incorporated by reference herein for all that is disclosed as though fully set forth herein.

BACKGROUND

Domestic water heaters heat water prior to use, for example, for showers and baths and washing dishes. There are several types of water heaters, including tank heaters which include a gas or electric heating element, tankless water heaters, and indirect water heaters.

Indirect water heaters have a water tank with a heat exchanger. The heat exchanger is fluidically connected to a boiler or other external heat source. The boiler heats a heating fluid that is circulated through the heat exchanger to heat the water in the water tank. The heated water is stored in the water tank so that it is ready on demand. When the temperature of the water in the tank drops below a threshold value, the heating fluid is again circulated through the heat exchanger to heat the water in the water tank.

Indirect water heaters are relatively efficient, utilizing a single heat source for both heating the home and heating water for the home. However, efficient use of energy resources is becoming a higher priority as the cost of heating fuels and electricity continues to rise. It is important to further increase the efficiency with which we use energy.

BRIEF DESCRIPTION OF THE DRAWINGS

FIGS. 2A and 2B is a cross-sectional view of the heat exchanger of the indirect water heater, wherein FIG. 2A is taken along lines 2A-2A in FIG. 1, and FIG. 2B is taken along lines 2B-2B in FIG. 1.

DETAILED DESCRIPTION

Figure 1:
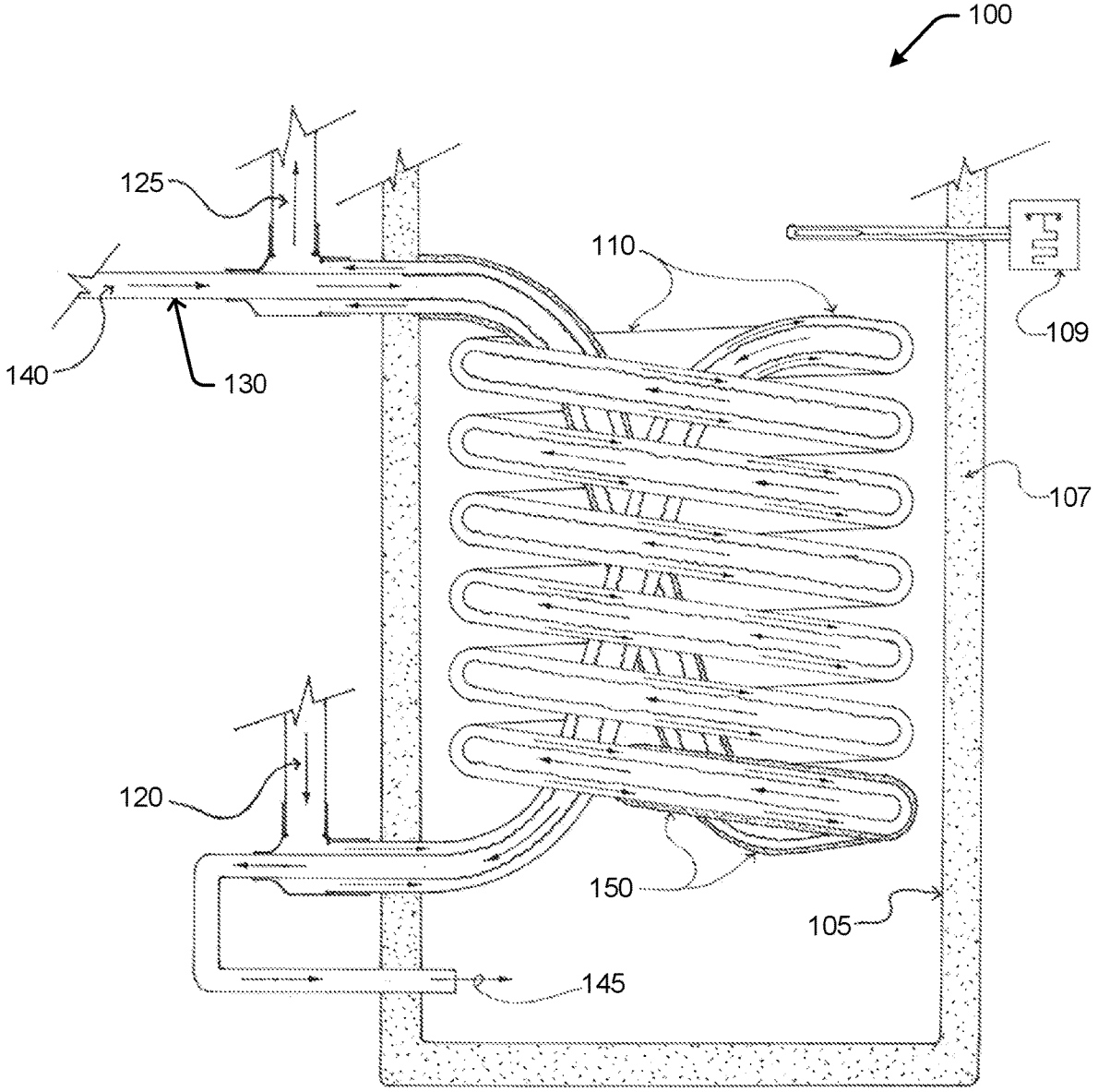
FIG. 1 shows an example of an indirect water heater.

An indirect water heater is disclosed which circulates colder influent water adjacent to the heating fluid in the heat exchanger. The indirect water heater preheats the cold influent water before it even enters the tank, and heats the water more efficiently. The indirect water heater may also increase the efficiency of the boiler or other heat source.

It is noted that several examples described herein are illustrated with reference to the external heat source being a boiler. However, the illustration of a boiler is only and example and is not intended to be limited to a boiler providing the heat input. Other external heat sources can include, but are not limited to, ground source heat pump systems, thermal solar panels, and air source heat heat pumps. The use of any of these systems (or the boiler) provide an increase in energy coefficient, as well as increased performance of domestic hot water production, when utilized in accordance with the disclosure herein.

An example indirect water heater includes a storage tank, an insulated jacket surrounding the tank, a heat exchanger inside the body of the tank, boiler supply and return ports, water inlet and outlet ports, and a thermal controller. In an example, the heat exchanger is a single large diameter coiled tube. When the domestic water within the storage tank drops below a predetermined temperature, the controller signals a boiler to circulate heating fluid through the heat exchanger. In an example, the heating fluid enters the heat exchanger at about 180° F. Generally, the domestic water surrounding the heat exchanger is below 125° F. As the heated water travels the length of the heat exchanger, it gives up heat to the surroundings, transferring at least some of that heat into the cooler water. The heated water exits the heat exchanger at around 150-160° F.

A water heater discharges heating fluid from its heat exchanger at 150-160° F. and is returned to the boiler for reheating. This 150-160° F. heating fluid still has significant potential for heat transfer. Perhaps not as much into the tanks 125° F. domestic water (where there is 25-30° F. of differential), but into the significantly cooler incoming supply water, entering the tank at (55° F.) ground temperature.

An indirect water heater is disclosed for harvesting additional energy from the discharging heating fluid. In an example, the indirect water heater utilizes the 150° F.-160° F. discharging heating fluid to transfer its heat into the 55° F. incoming domestic water supply. This provides a 95° F.-105° F. differential, dramatically increasing heat transfer. In doing so, the device preheats incoming domestic water prior to entering the tank, as well as reduces the temperature of heating fluid returning to the boiler. This improvement significantly increases both efficiency and performance in several ways.

The example indirect water heater may be implemented in conjunction with a High efficiency (condensing) boiler. The example indirect water heater increases energy efficiency. Condensing boilers increase in efficiency as the temperature of the returning heating fluid is decreased. When heating fluid returns to the boiler at 150° F.-160° F., the boiler operates at around 85% efficiency. If the temperature of the returning fluid drops below 135° F., the boiler begins to condensate causing latent heat to be absorbed into the circulating fluid. By implementing a heat exchanger to harvest additional heat from the returning heating fluid and lowering the returning fluid to a temperature of 110° F.-120° F., the condensing boiler efficiency increases to 90-93%. Anytime that there is a call for heat and domestic water is drawn from the tank, the incoming domestic water absorbs a significant amount of heat from the heating fluid prior to entering the tank. The reduced temperature of the returning heating fluid varies based on flow rates and input temperatures.

The example indirect water heater increases performance. As domestic hot water is drawn from a traditional water heater, the incoming supply water most often enters the tank at ground temperature. The ground temperature of the entering water can vary, however if the incoming water is 55° F. and the setpoint of the controller on the indirect water heater is 125° F. there is a differential of 80° F. By providing the heat exchanger described herein, the incoming domestic water temperature can be raised by 30° F.-60° F. So instead of 55° F. domestic water entering the tank, 85° F.-115° F. water enters the tank. Preheated supply water entering the tank at 85° F.-115° F. will recover much faster than that of supply water entering at 55° F. The added heat varies with flow rates, boiler equipment, setup temperatures and other contributors.

The example indirect water heater reduces carbon footprint. The indirect water heater performs significantly better than the same size tank of its traditional counterpart. This allows for a smaller, redesigned, indirect water heater to be used in place of its larger, unmodified cousin. The manufacture of this smaller tank should also provide a reduction in raw material usage, transportation, packaging, and warehousing. There is also a reduction in the amount of fuel consumed by the condensing boiler for the same hot water output.

Before continuing, it is noted that any reference to specific numbers (e.g., sizes, temperature, etc.) are examples to illustrate embodiments of the indirect water heater and are not intended in any way to be limiting thereto.

It is also noted that as used herein, the terms "includes" and "including" mean, but is not limited to, "includes" or "including" and "includes at least" or "including at least." The term "based on" means "based on" and "based at least in part on." The following terms used herein are also defined as set forth below.

The term "heating fluid" as used herein refers to circulating fluid that picks up heat as it passes through a boiler (or other heating equipment) and delivers that heat, by way of controls and piping to a variety of possible devices.

The term "heat exchanger" as used herein refers to a tubular coil that transfers heat energy by way of circulating heating fluid. As the heating fluid travels the length of the heat exchanger, the heat energy contained in the heating fluid transfers heat through the wall of the heat exchanger and into the cooler domestic water of the tank. The indirect water heater described herein includes improvements over traditional heat exchangers.

The terms "tees," "modified tees," and "modified reducing tees as those terms are used herein refer to split flow paths that allow independent pathways for both the potable water and the heating fluid to transfer and absorb heat effectively, without cross contamination. A modified reducing tee (e.g., 1¼"×¾"×1" tee) can be manufactured similar to a traditional tee, but with the stop removed from the through section (e.g., the ¾" side) of the tee. Removing the stop on this end enables the domestic inlet and outlet ends of the ¾" smaller diameter concentric tube to terminate beyond the 1¼" body of the heat exchanger. This allows for a continuous section of tubing of the smaller diameter concentric tube, so that the domestic connections are made on the exterior of the heat exchanger. The stops stay in place on the 1" branch and the 1¼" sides of the tees, providing for the 1" inlet and outlet ports of the boiler supply and return as well as the 1¼" larger diameter concentric tube of the heat exchanger.

The term "domestic outlet" as used herein refers to a threaded outlet port at a top portion of the indirect water heater that enables heated domestic water to flow from the tank to a point of use.

The term "domestic inlet" as used herein refers to an inlet port which provides replenished domestic water as hot water is drawn from the tank. On a traditional water heater, domestic water usually enters directly into the bottom of a tank through a threaded port. The water is typically entering the bottom of the tank at a temperature (55° F.) close to ground temperature. But with the indirect water heater described herein, domestic supply water is connected to an inlet port that directs incoming domestic water in a way that provides heat exchange with heating fluid prior to entering the domestic tank.

The term "insulated domestic exchange" as used herein refers to isolating heat exchange between the heating fluid and incoming domestic water away from the thermal influences of the tank water. Insulated domestic exchange is accomplished differently in each embodiment described herein. In the example shown in FIG. 1, it is a section of submersible insulation. In the example shown in FIG. 3, it is a larger insulated concentric length of tubing. In the example shown in FIGS. 4 and 5, it is an insulated tank bladder. Insulated domestic exchange further enhances the effectiveness of this design, but is not necessary in all embodiments.

The term "supply from the boiler" as used herein refers to a port that receives heating fluid leaving the boiler and circulating through the larger diameter coiled tube of the heat exchanger of the indirect water heater.

The term "return to boiler" as used herein refers to heating fluid exiting the larger diameter coiled tube of the heat exchanger and returning to the boiler where additional heat energy is added.

It is noted that for the purposes of describing increases in performance and efficiency, it helps to assign set thermal values to the domestic inlet and outlet as well as heating fluid at the supplying and returning ports of the heat exchanger. These values are for purposes of illustration only and are not intended to be limiting. The values in this illustration apply when domestic water is flowing through the tank and there is a call for heat. Although these values are realistic, it should also be understood that these set thermal values will vary by region, equipment setup, system design, flow rates, and other variables. It is also recognized that thermal values do not remain static throughout the cycle in which the call for heat occurs. For purposes of illustration, the example thermal values are as follows:

| | |
|---|---|
| Supply from Boiler | 180° F. |
| Return to Boiler | 100° F.-130° F. (indirect water heater) |
| Return to Boiler | 150° F.-160° F. (traditional heat exchanger) |
| Water heater Set point | 125° F. |
| Uncaptured Heat Energy (of returning heating fluid) | 35° F.-45° F. (traditional heat exchanger) |
| Preheated domestic supply | 85° F.-115° F. (indirect water heater) |
| Domestic Water Supply | 55° F. |

It is noted that the examples described herein are provided for purposes of illustration, and are not intended to be limiting. Other devices and/or device configurations may be utilized to carry out the operations described herein.

The operations shown and described herein are provided to illustrate example implementations. It is noted that the operations are not limited to the ordering shown. Still other operations may also be implemented.

FIG. 1 shows an example of an indirect water heater 100. The drawing in FIG. 1 is a cross-sectional illustration, showing the water storage tank 105 in cross section, along with a cross-section of the heat exchanger coils. The example indirect water heater 100 includes a water storage tank 105 with a primary heat exchanger 110. The water storage tank 105 may be insulated (e.g., insulation 107). A thermal controller 109 may be provided to monitor temperature of the water in the water storage tank 105, and actuate the heat exchanger to maintain the temperature of the water at a threshold temperature.

A heating fluid inlet 120 of the primary heat exchanger receives a heating fluid from a boiler or other external heat source into the primary heat exchanger 110. A heating fluid outlet 125 of the primary heat exchanger 110 returns the heating fluid to the boiler or other external heat source after traveling through the primary heat exchanger 110.

The example indirect water heater 100 includes a secondary heat exchanger 130 has a water source inlet 140 and a water source outlet 145. The secondary heat exchanger 130 is provided in thermal connection with the primary heater exchanger 110 to preheat a source water (e.g., domestic water supply provided at inlet 140) before discharging the source water from the water source outlet 145 into the water storage tank 105.

In an example, the secondary heat exchanger 130 is provided along an entire length of the primary heat exchanger within the water storage tank 105. In another example, the secondary heat exchanger 130 is only provided along a portion of the primary heat exchanger 110 within the water storage tank 105. The secondary heat exchanger 130 may be provided along only a portion of the primary heat exchanger 110 by insulation 150 around the outside of the coils provided along only a portion of the primary heat exchanger 110, as shown in FIG. 1, thereby thermally isolating the primary heat exchanger 110 from water in the water storage tank 105. This insulation 150 serves as a thermal break between the primary heat exchanger 110 and the source water already in the storage tank by forming a section of the primary heat exchanger 110 devoted only to heat transfer from the heating fluid into the source water in the secondary heat exchanger 130.

In an example, the heat exchangers are configured as separate concentric tubes, including an inner tube and an outer tube. In an example, heating fluid from the boiler flows within the space formed between the inner tube and the outer tube as the primary heat exchanger element. The source water to be preheated flows within the inner tube as the secondary heat exchanger element. Heat transfers from the heating fluid in the primary heat exchanger 110 into the source water in the secondary heat exchanger 130.

It is noted that other configurations of the heat exchanger are also contemplated. For example, as shown in FIGS. 2A and 2B and described below, the secondary heat exchanger for the source water is provided as the inner tube, within the outer tube which serves as the primary heat exchanger for the heating fluid.

In an example, the heating fluid flows through the primary heat exchanger 110 in a direction counter to flow of the source water in the secondary heat exchanger 130. The primary function of the heating fluid is to transfer heat into source water already in the water storage tank 105 and maintain the temperature of the water for end use. But the heating fluid has additional heat that can be used to preheat the influent source water before entering the storage tank 105.

Figure 2A:
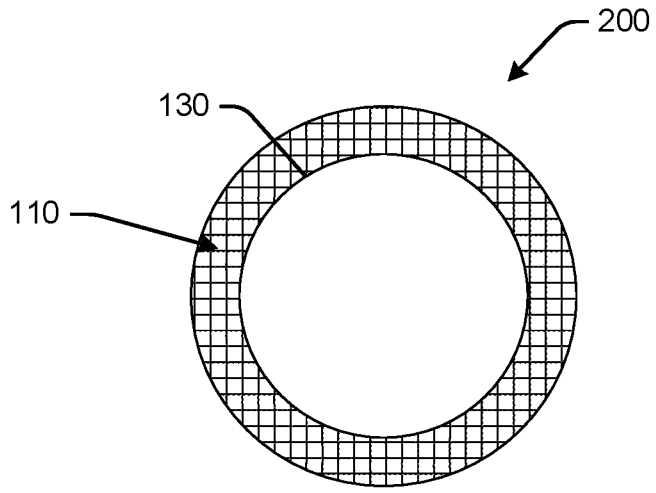
Figure 2B:
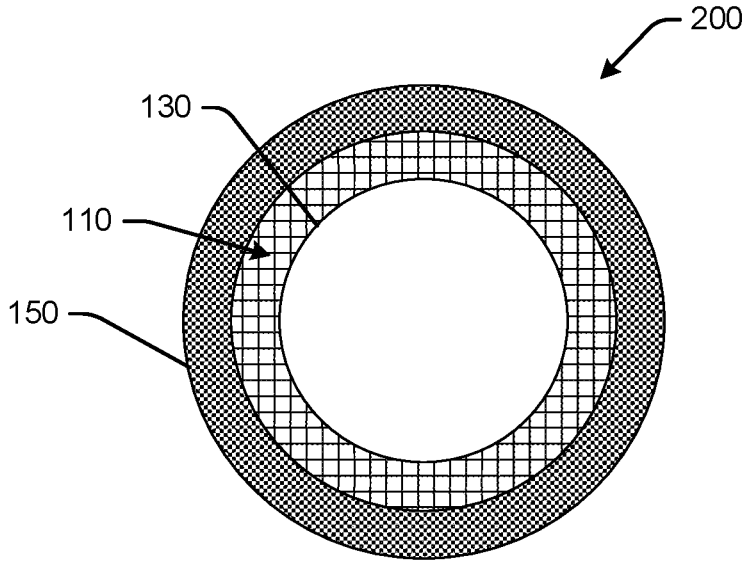

FIGS. 2A and 2B is a cross-sectional view 200 of the heat exchanger of the indirect water heater. FIG. 2A is taken along lines 2A-2A in FIG. 1. FIG. 2B is taken along lines 2B-2B in FIG. 1. As shown in FIGS. 2A and 2B, the heat exchanger includes two concentric coiled tubes 110 and 130 within the water storage tank 105. Each of the two coiled tubes provide for the transfer of heat from a circulating heating fluid (boiler supplied) into the domestic water. However each coiled tube 110 and 130 transfers that heat in different ways. That is, the heating fluid enters the space between the concentric tubes 110 and 130, and the domestic water enters the smaller diameter or inner concentric tube 130. The incoming domestic water in the smaller diameter concentric tube 130 and the heating fluid within the space of the concentric tubes flow counter-current to each other.

In an example, the space within the larger diameter or outer concentric tube 110 is like that of an unmodified indirect water heater, in that it transfers heat into the domestic water of the water storage tank 105, maintaining that water to a desired set point temperature. This is accomplished within the top uninsulated portion of the heat exchanger. The lower insulated portion of this tube is wrapped with a length of submergible insulation 150, on the "return to boiler" end of the concentric tubes. The insulation 150 provides a thermal break between the heating fluid and the domestic water in the tank. In doing so, this section of the heat exchanger is devoted only to the transfer of heat from the heating fluid (prior to discharging the heat exchange) and into the inflowing (55° F.) domestic water.

In an example, the tubing may be corrugated or straight. Corrugated tubing greatly enhances the transfer of heat on both sides of the wall. That is, there is more surface area with a corrugated tube over similar length of smooth tubing. In addition, the corrugated surface acts upon the movement of the fluid as it flows past causing more turbulence than in smooth wall tubing, this turbulence enhances the process of heat transfer.

In an example, the smaller diameter inner tube is a continuous section of corrugated or straight tubing with a short straight (non corrugated) section on both ends. The inlet side of the smaller diameter inner tube protrudes through the unstopped end of a modified reducing tee so that connection to the domestic supply is made outside of the water storage tank 105. The outlet side of the smaller diameter inner tube passes out through the unstopped reducing tee at the other end of the heat exchanger and loops back where it connects to the domestic inlet at the bottom of the water storage tank 105.

Anytime that there is a call for heat and domestic water is drawn from the water storage tank 105, the incoming domestic water absorbs heat from the surrounding jacket of heating fluid and is preheated prior to entering the water storage tank 105. In addition, the heating fluid returns to the boiler at a much lower temperature.

Figure 3:
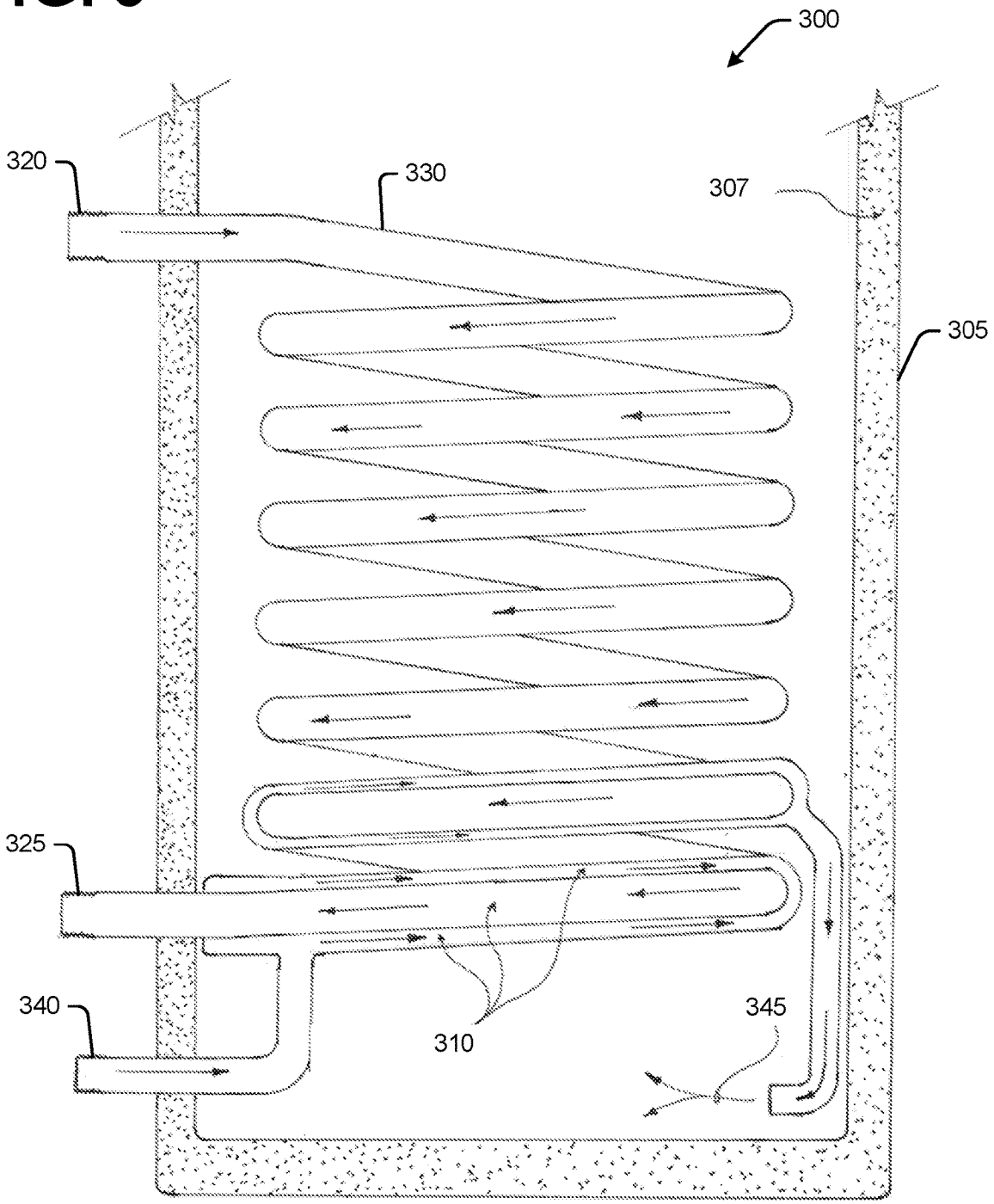
FIG. 3 shows another example of an indirect water heater.

FIG. 3 shows another example of an indirect water heater 300. The example indirect water heater 300 includes a storage tank 305, an insulated jacket 307 surrounding the tank 305, a single coiled tube primary heat exchanger 330 for the heating fluid from the boiler, and a larger insulated concentric partial length of tubing forming the secondary heat exchanger 310 for preheating the influent source water. The indirect water heater 300 also includes a water source inlet 340 and a water source outlet 345.

A heating fluid inlet 320 of the primary heat exchanger receives a heating fluid from a boiler or other external heat source into the primary heat exchanger 310. A heating fluid outlet 325 of the primary heat exchanger 310 returns the heating fluid to the boiler or other external heat source after traveling through the primary heat exchanger 310.

The secondary heat exchanger 330 is provided in thermal connection with the primary heater exchanger 310 to preheat a source water (e.g., domestic water supply provided at inlet 340) before discharging the source water from the water source outlet 345 into the water storage tank 305.

In an example, heating fluid is supplied by a boiler at 180° F. and circulates through a single coiled tube (heat exchanger 330) within the water storage tank 305. As the heating fluid moves through the top portion of the heat exchanger, heat transfers through the wall of the heat exchanger into the domestic water already in the water storage tank 305, eventually satisfying the thermal controller by maintaining the threshold temperature. The lower portion of the heat exchanger 330 is encompassed within a larger insulated tube forming the secondary heat exchanger 310 with the source water.

During operation, domestic supply or source water (55° F.) enters the indirect water heater 300 through a domestic inlet port 340 located at the bottom of the water storage tank 305. Inside the tank 305 a connecting tube directs the supply water from the inlet port to the "insulated concentric portion" of the secondary heat exchanger 310. Domestic supply water from the connecting tube enters the space between the concentric tubes and flows counter to the heating fluid of the inner tube or primary heat exchanger 330.

As the domestic water moves the length of the concentric tubes it is thermally insulated from the tank water and only absorbs heat from the boiler supplied heating fluid. Preheated domestic water exits the lower insulated concentric portion of the heat exchanger 310 and enters the water storage tank 305 at outlet 345. Anytime that there is a call for heat and domestic water is drawn from the water storage tank 305, the incoming domestic water is absorbing heat from the heating fluid and being preheated prior to entering the water storage tank 305. In addition, the heating fluid gives up additional heat before returning to the boiler. Again, the single coiled tube heat exchanger in this design can be corrugated or straight.

Figure 4:
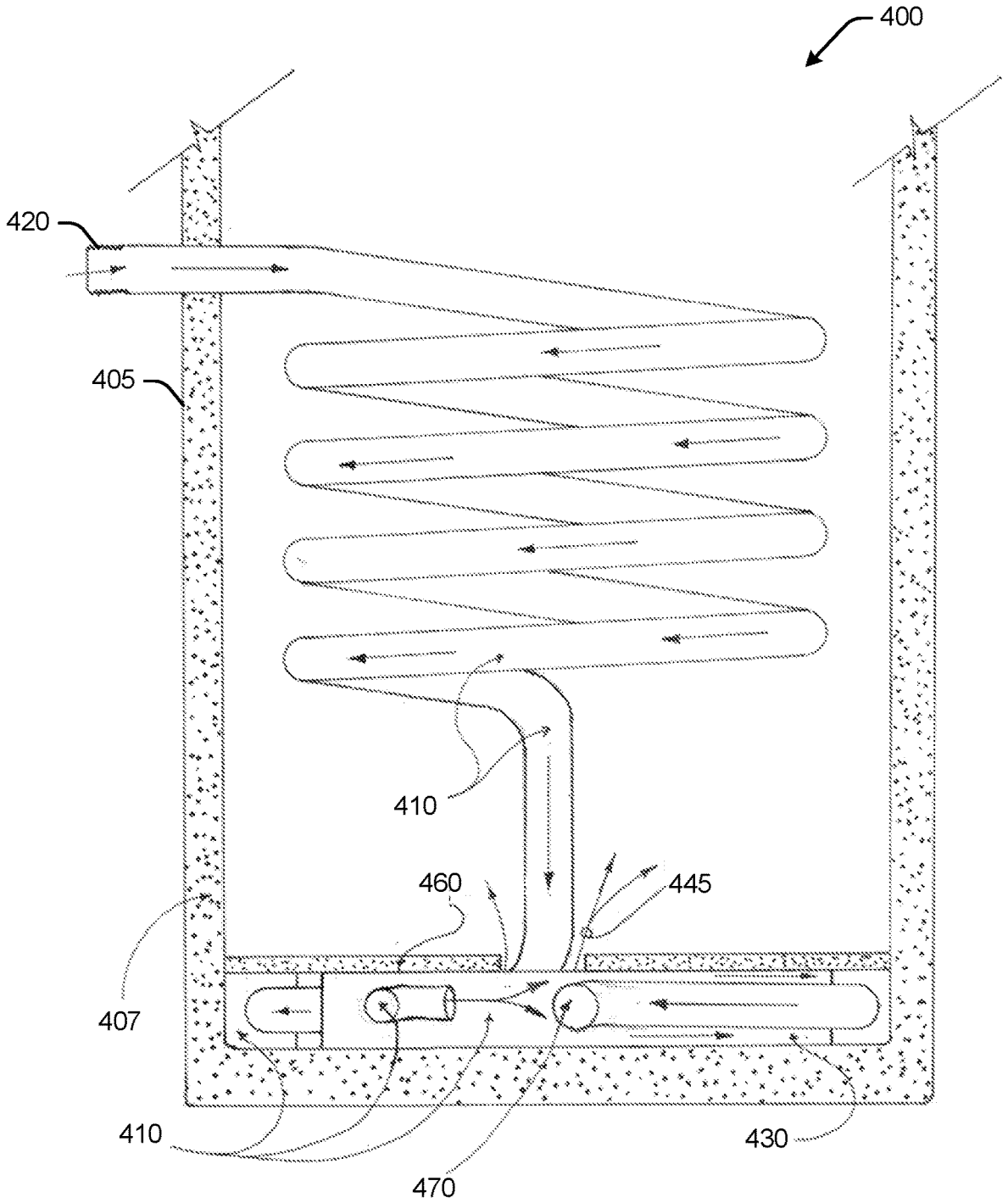
FIG. 4 shows another example of an indirect water heater.
Figure 5:
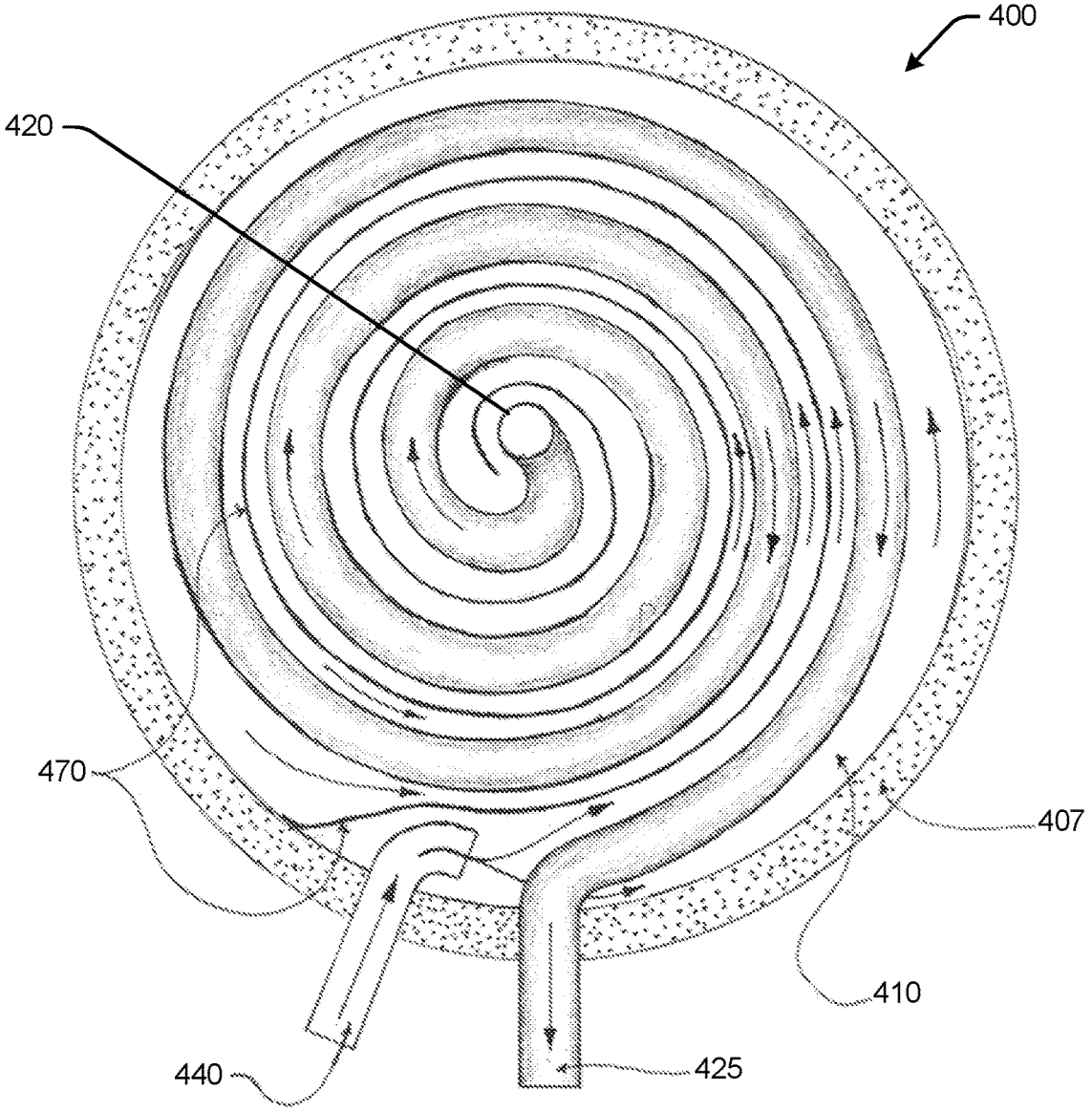
FIG. 5 is a top view of the indirect water heater taken along lines 5-5 in FIG. 4.

FIG. 4 shows another example of an indirect water heater 400. FIG. 5 is a top view of the indirect water heater 400 taken along lines 4-4 in FIG. 4. The example indirect water heater 400 includes a water storage tank 405, an insulated jacket 407 surrounding the tank 405, a single coiled tube forming the primary heat exchanger 410 and a secondary heat exchanger 420. In this example, the secondary heat exchanger is formed by an insulated tank bladder 460 and channeling material 470 in the lower portion of the water supply tank 405. The indirect water heater 400 also includes a water source inlet 440 and a water source outlet 445.

A heating fluid inlet 420 of the primary heat exchanger 410 receives a heating fluid from a boiler or other external heat source into the primary heat exchanger 410. A heating fluid outlet 425 of the primary heat exchanger 410 returns the heating fluid to the boiler or other external heat source after traveling through the primary heat exchanger 410.

The secondary heat exchanger 430 is provided in thermal connection with the primary heater exchanger 410 to preheat a source water (e.g., domestic water supply provided at inlet 440) before discharging the source water from the water source outlet 445 into the water storage tank 405.

During operation, heating fluid supplied by a boiler at 180° F. circulates through a single coiled tube primary heat exchanger 410 within the tank 405 of the indirect water heater 400. A section of the discharging end of the primary heat exchanger 410 extends through an opening in a lower chamber or bladder 460 at the bottom of the tank 405. The bladder 460 forms a heat exchange chamber at the bottom of the tank 405, and is insulated in order to form a thermal break between the upper chamber (for water storage) and the lower chamber for secondary heat exchange. The opening in the center of the bladder 445 is large enough to allow both the diameter of the heat exchanger and incoming domestic water to pass.

In an example, a portion of the heat exchanger 430 passing through the bladder 460 into the bottom chamber coils from the center outward in increasing concentric loops toward the wall of the tank 405. The primary heat exchanger 410 discharges heating fluid through an exit port 425 at the tank wall of the bottom chamber. A vertical strip of channel material 470 is installed between the loops of the secondary heat exchanger 430 in the bottom chamber, forming a channel for incoming domestic water to flow along the length of the heat exchanger 430.

As the domestic water enters through a port into the bottom chamber the insulated bladder 460 provides a thermal break from the water already stored in the tank 405. This thermal break allows the heating fluid from the boiler, and the influent domestic water to exchange heat with each other without thermal interference from the stored water in the tank 405. The channel 470 concludes near the opening at the center of the bladder 460, where the preheated domestic incoming water enters the upper chamber of the tank 405 through the opening.

When there is a call for heating fluid (to heat the water in the tank 405), and domestic water is also drawn from the tank 405, the incoming domestic water absorbs heat from the heating fluid and is preheated prior to entering the tank 405. In addition, the heating fluid returns to the boiler at a much lower temperature. Again, the single coiled tube heat exchanger in this design can be corrugated or straight.

It is noted that the examples shown and described are provided for purposes of illustration and are not intended to be limiting. Still other examples are also contemplated.

The invention claimed is:

1. An indirect water heater, comprising:

a water storage tank;

a heating fluid that is a liquid;

a primary heat exchanger in the water storage tank;

a heating fluid inlet of the primary heat exchanger for receiving a heating fluid from an external heat source into the primary heat exchanger;

a heating fluid outlet of the primary heat exchanger for returning the heating fluid to the external heat source after traveling through the primary heat exchanger; and a secondary heat exchanger having a water source inlet configured to receive a source water, and a water source outlet configured to discharge the source water from the secondary heat exchanger into the water storage tank, the secondary heat exchanger provided in thermal connection with the primary heat exchanger to preheat the source water from the water source inlet in the secondary heat exchanger, wherein the preheated source water from the secondary heat exchanger is discharged via the water source outlet into the water storage tank;

wherein the primary and secondary heat exchangers are defined by separate concentric tubes including an inner tube and an outer tube, the primary heat exchanger configured as a space formed between the inner tube and the outer tube, and the secondary heat exchanger configured as the inner tube, wherein heat transfers from the heating fluid in the primary heat exchanger into the source water in the secondary heat exchanger.

2. The indirect water heater of claim 1, wherein the heating fluid flows through the primary heat exchanger in a direction counter to flow of the source water in the secondary heat exchanger.

3. The indirect water heater of claim 1, wherein the heating fluid also transfers heat into source water already in the water storage tank.

4. The indirect water heater of claim 1, further comprising a thermal break between the primary heat exchanger and the source water already in the storage tank to form a section of the primary heat exchanger devoted only to heat transfer from the heating fluid into the source water in the secondary heat exchanger.

5. The indirect water heater of claim 1, wherein the primary heat exchanger and the secondary heat exchanger are at least partly corrugated.

6. The indirect water heater of claim 1, wherein the primary heat exchanger and the secondary heat exchanger are straight.

7. The indirect water heater of claim 1, wherein the secondary heat exchanger is provided along an entire length of the primary heat exchanger within the water storage tank.

8. The indirect water heater of claim 1, wherein the secondary heat exchanger is only provided along a portion of the primary heat exchanger within the water storage tank.

9. The indirect water heater of claim 8, wherein the secondary heat exchanger for the source water is provided within the primary heat exchanger for the heating fluid.

* * * * *